US006070523A

United States Patent [19]

Burns et al.

[11] Patent Number: 6,070,523

[45] Date of Patent: Jun. 6, 2000

[54] PRESS DYNAMIC BALANCER GUIDE SYSTEM

[75] Inventors: Bradley A. Burns, Wapakoneta; Brian A. Watercutter, Minster, both of Ohio

[73] Assignee: The Minster Machine Company, Minster, Ohio

[21] Appl. No.: 09/193,951

[22] Filed: Nov. 18, 1998

[51] Int. Cl.[7] ..... B30B 1/06

[52] U.S. Cl. ..... 100/282; 83/615

[58] Field of Search ..... 100/214, 282; 72/452.5; 74/603, 589; 83/615, 632

[56] References Cited

U.S. PATENT DOCUMENTS

| | | | |
|---|---|---|---|
| 1,241,257 | 9/1917 | Wurts et al. . | |
| 2,357,557 | 9/1944 | Sherman et al. | 83/615 |
| 3,049,029 | 8/1962 | Schaming . | |
| 3,130,699 | 4/1964 | Ward . | |
| 3,157,113 | 11/1964 | Jewett . | |
| 3,921,286 | 11/1975 | Petersen . | |
| 4,095,522 | 6/1978 | Drungil . | |
| 4,652,146 | 3/1987 | Ellermann et al. . | |
| 4,674,357 | 6/1987 | Sugawara et al. . | |
| 4,746,227 | 5/1988 | Sato . | |
| 4,748,883 | 6/1988 | Portmann | 100/282 |
| 4,757,734 | 7/1988 | Portmann | 100/282 |
| 4,817,456 | 4/1989 | Imanishi et al. | 100/282 |

*Primary Examiner*—Stephen F. Gerrity
*Attorney, Agent, or Firm*—Randall J. Knuth

[57] ABSTRACT

A guide system for a dynamic balancer for use in a mechanical press. This system includes a dynamic balancer weight which reciprocates along a longitudinal axis and guiding means for preventing rotation of the balancer weight about the balancer weights reciprocal pathway longitudinal axis. In one particular embodiment, the system includes a guide post attached to the balancer weight and a "U"-shaped weight guide circumferentially located about the guide post whereby preventing rotational movement of the balancer weight around the guide post.

10 Claims, 3 Drawing Sheets

PRESS DYNAMIC BALANCER GUIDE SYSTEM

BACKGROUND OF THE INVENTION

1. Field of the Invention

The present invention relates to a dynamic balancing guide system and, in particular, a press dynamic balancer guide system in which rotation of a balancer weight around the axis of reciprocation is prevented.

2. Description of the Related Art

Mechanical presses such as straight side presses and gap frame presses for stamping and drawing comprise a frame for reciprocal motion towards and away from the bed. The slide is driven by a crankshaft having a connecting arm connected to the slide to which is mounted the upper die. The lower die is mounted to a bolster which, in turn, is connected to the bed. Such mechanical presses are widely used for blanking and drawing operations and varying substantially the size and available tonnage depending on their use.

The primary source of stored mechanical energy in a mechanical press is a flywheel. The flywheel is located between the main drive and the clutch. The flywheel and the flywheel bearings are mounted on either the driveshaft, crankshaft, or the press frame by use of a quill. The main motor replenishes the energy lost from the drive wheel during press stamping operations when the clutch couples the flywheel to the press driven parts. During engagement of the clutch, the flywheel drops in speed and the press drive parts come up to press running speeds. During engagement with the clutch, the press wheel rotates in unison with the clutch while the flywheel bearings have no relative motion, except in the case of the use of the quill where relative motion is always present.

During press operation, the slide reciprocates up and down creating inertial forces on the press components. Balancer weights have been used to dynamically balance these inertial forces. Typically, the balancer weights have been guided either by guide posts or balancer guides.

One problem with the prior art is that the difference in thermal expansion of the balancer weight and the press frame limits the effectiveness of the current guide system. The balancer weight, because of its large mass, does not heat up or cool down at the same rate as the press frame where part of the balancer guide system is mounted. The different thermal expansion of the balancer weight as compared to the press frame causes the running clearance to be reduced or eliminated altogether in the current type of guide systems. If the clearance between the balancer weight and balancer guide system is too small, the guide system may seize and/or cause high wear resulting in a very short life of the guide system.

One current solution to reduce the effects of thermal expansion is to provide additional running clearance in the guide system which allows for thermal expansion. A drawback to this solution is that this added clearance, if too large, results in greater axial and rotational movement of the balancer weight about the longitudinal axis or reciprocation causing more vibration to be added to the press. This vibration may then be translated into the press ram or slide causing unwanted ram movement thus, affecting part quality. In addition, high wear may occur on the balancer guide system as a result of high vibration caused by too much clearance.

Therefore, the goal of this present invention is to produce a dynamic balancer guide system which assures proper running clearance to prevent thermal close-out while ensuring that the clearance is not too great causing high vibration and wear.

SUMMARY OF THE INVENTION

According to the present invention, a dynamic balancer guide system guides the travel path of the dynamic balancer weight. The dynamic balancer system prevents the rotation or motion of the balancer weight around the axis of the balancer weight's travel path.

The invention, in one form thereof, is a guide system for a dynamic balancer for a mechanical press. The guide system includes a dynamic balancer weight with an aperture. A balancer guide post is disposed within the aperture. The balancer weight is reciprocateably mobile along the balancer guide post's longitudinal axis. Guiding means prevents rotation of the balancer weight around the balancer guide post's longitudinal axis. In a further embodiment, the guide means includes a guide post attached to the balancer weight and at least one weight guide disposed at least partially circumferentially about the guide post whereby preventing rotational movement of the balancer weight about the guide post. In one particular embodiment, the weight guide is "U"-shaped with an inner surface adjacent the guide post.

The invention, in another form thereof, is a guide system for a dynamic balancer for a mechanical press. The guide system includes a dynamic balancer weight and a guide post attached to the balancer weight. At least one weight guide is disposed at least partially circumferentially about the guide post whereby, preventing rotational movement of the balancer weight about the guide post. In a further embodiment, the weight guide is "U"-shaped with an inner surface adjacent the guide post. In yet a further embodiment, the weight guide inner surface contains hydrostatic/hydrodynamic bearings. In one particular embodiment, the guide system includes a balancer guide post disposed within an aperture through the balancer weight such that the balancer weight is reciprocateably mobile along the balancer guide post.

The invention, in yet another form thereof, is a mechanical press. The press includes a frame with crown and bed. There is a slide for reciprocating movement in opposed relationship to the bed. A dynamic balancer weight is connected to the slide. A guide post is attached to the dynamic balancer weight. At least one weight guide post is attached to the frame and is disposed at least partially circumferentially about the guide post whereby preventing rotational movement of the balancer weight about the guide post. A flywheel is rotatably driven by the drive mechanism and is mounted to the frame structure. A crankshaft is rotatably disposed within the frame structure and in driven connection with the slide. A crankshaft is selectively connectable with the flywheel for drive rotation thereby. In a further embodiment, the weight guide is "U"-shaped with an inner surface adjacent the guide post. In yet a further embodiment, the balancer guide post is disposed within a balancer weight aperture whereby the balancer is reciprocateably mobile along the balancer guide post.

The invention, in additional form thereof, is a mechanical press which includes a frame with a crown and a bed. A slide is included for reciprocal movement in opposed relationship to the bed. A dynamic balancer weight is connected to the slide and contains an aperture. A balancer guide post is disposed within the aperture. The balancer guide post has a longitudinal axis. The balancer weight is reciprocateably mobile along the balancer guide post longitudinal axis. A balancer guide post bushing is attached to the balancer weight and is disposed between the balancer weight and the balancer guide post. A guide post with wear plate affixed thereon is attached to the balancer weight. There is at least one "U"-shaped weight guide containing hydrostatic/hydrodynamic bearing surfaces disposed about the guide post with the bearing surfaces adjacent the guide post whereby preventing rotational motion of the balance weight about the guide post. A drive mechanism is attached to the frame structure. A flywheel is rotatably driven by the drive mechanism and is mounted to the frame structure. A crankshaft is rotatably disposed within the frame structure and in driven connection with the slide. The crankshaft is selectively connectable with the flywheel for driving rotation thereby.

An advantage of the present invention is that the dynamic balancer guide system allows for a thermal expansion differential between the balancer weight and the press frame. The "U"-shaped weight guide permits no guiding to be required at the open end. Consequently, ample clearance exists to provide room for thermal expansion. Therefore, the present invention eliminates the potential problem of having too little running clearance and the drawbacks associated with providing too much running clearance. Thus, the potential problem of a guide system seizing due to too little clearance and excessive vibration resulting from too much clearance have been eliminated by the present invention.

A second advantage of the present invention is the improvement of press ram or slide accuracy and part quality. The improvement is a result of the balancer weight being guided more accurately which reduces or eliminates the vibration transmitted into the press ram by the balancer weight. In addition, the reduction or elimination in vibration will also provides longer guide bearing life.

An additional advantage of the present invention is that assembly is simplified because the running clearance between the balancer guides and/or guide posts do not need to be adjusted to allow for thermal expansion. A thermal expansion gap is built into the present inventions guide system which provides a space for this expansion growth to occur with no effect to the guide system.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
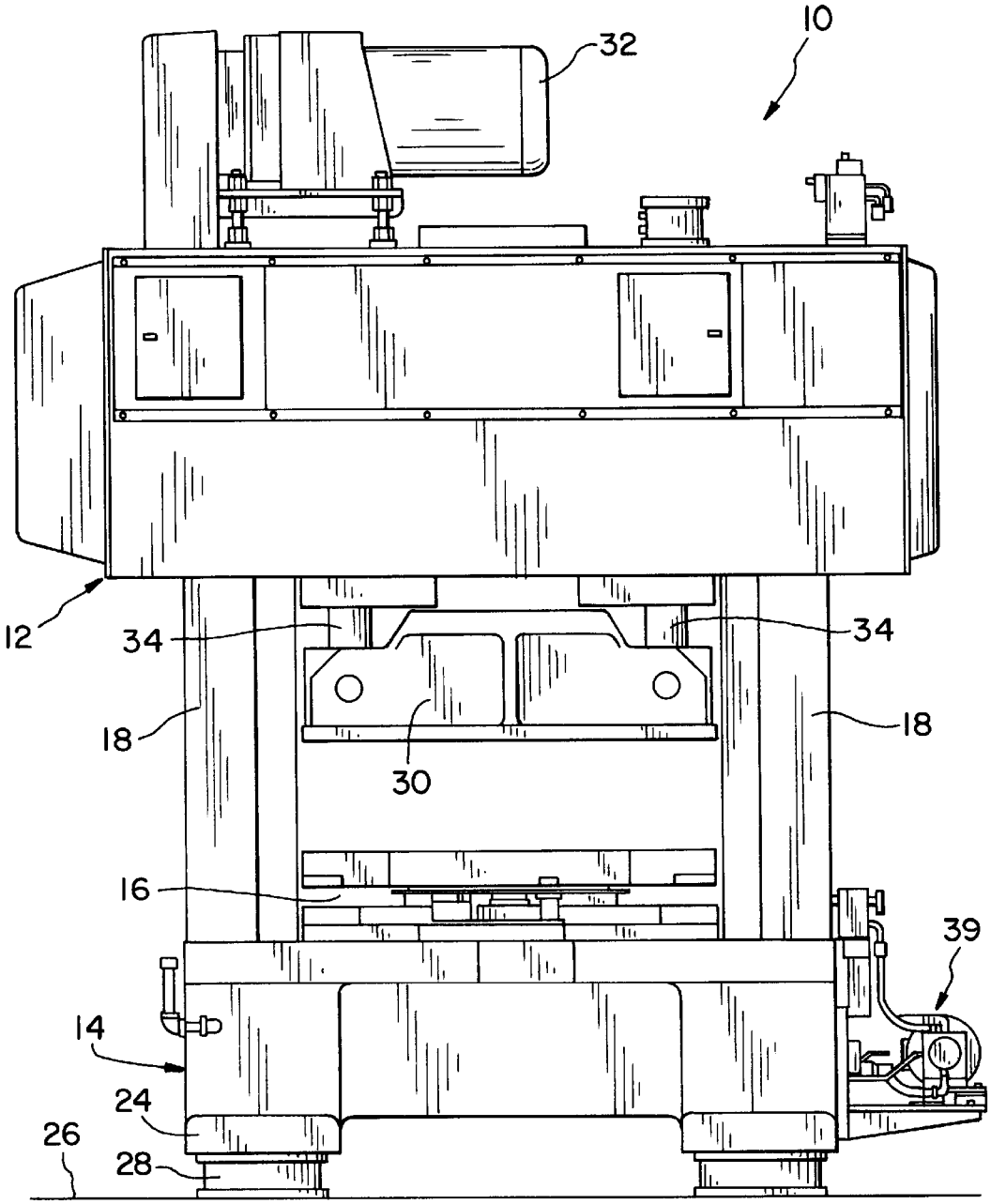
FIG. 1 is a front elevational view of a mechanical press incorporating the present invention.

Referring now to the drawings and particularly to FIG. 1, there is shown a front view of a mechanical press 10 which incorporates the present invention. Press 10 includes crown portion 12 bed portion 14 in uprights 18 connecting crown 12 with bed portion 14. Uprights 18 are connected to or integral with the underside of crown 12 and the upper side of bed 14. Tie rods (not shown) extent through crown 12, uprights 18 and bed 14 and are secured on opposite ends with tie rod nuts. Leg members 24 are formed as an extension of bed 14 and are generally mounted on shop floor 26 by means of shock absorbing pads 28.

A press drive motor 32 is mounted to crown 12 and used to operatively shift slide 30 and reciprocating fashion toward and away from bolster assembly 16 mounted on press bed 14. For example, drive motor 32 is connected by a clutch/brake mechanism (not shown) to a crankshaft to which connecting rods (not shown) are operatively attached. Other drive mechanisms known in the art may also be employed. A hydraulic pump 39 connected to press 10 may be employed to furnish the pressurized fluid such as oil that is required to operate the dynamic balancer guide system discussed below.

The above description of press 10 is not intended to so limit the invention as otherwise configured presses may be equipped with the dynamic balancer guide system. For example, rather than a single action press as press 10, a dual action press may be used in the incorporation of the present invention.

Figure 2:
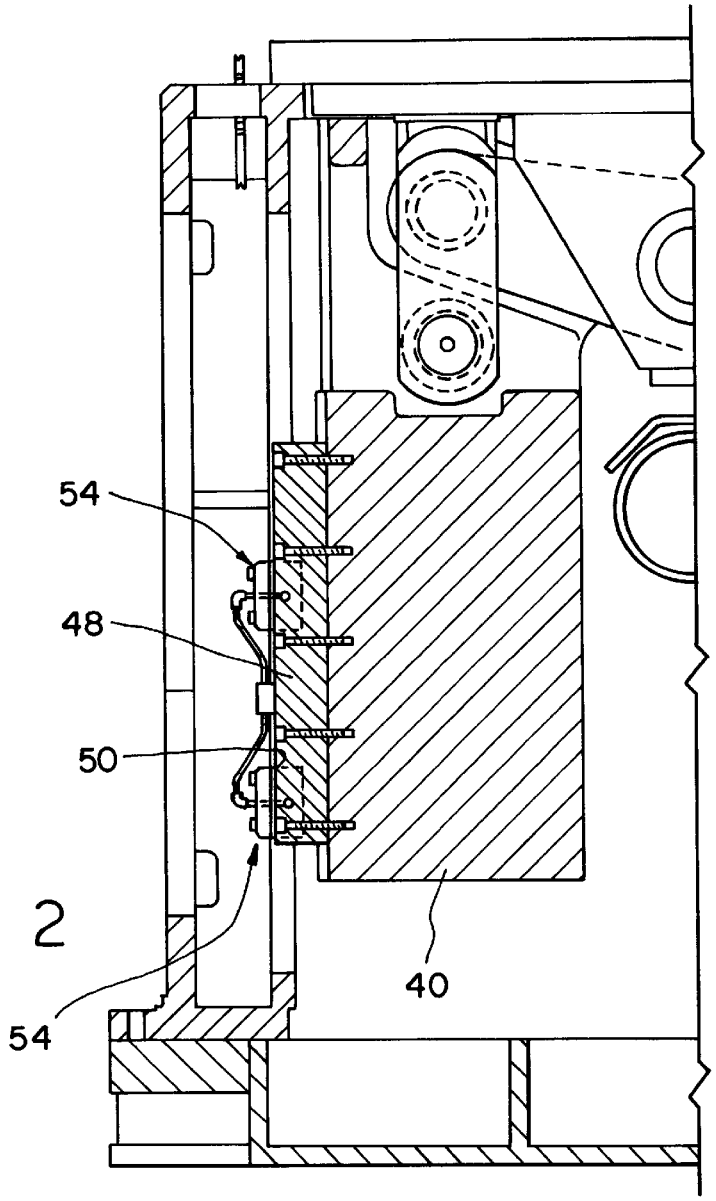
FIG. 2 is a cut-away view showing a balancer weight with wear plate attached to weight guide post.
Figure 5:
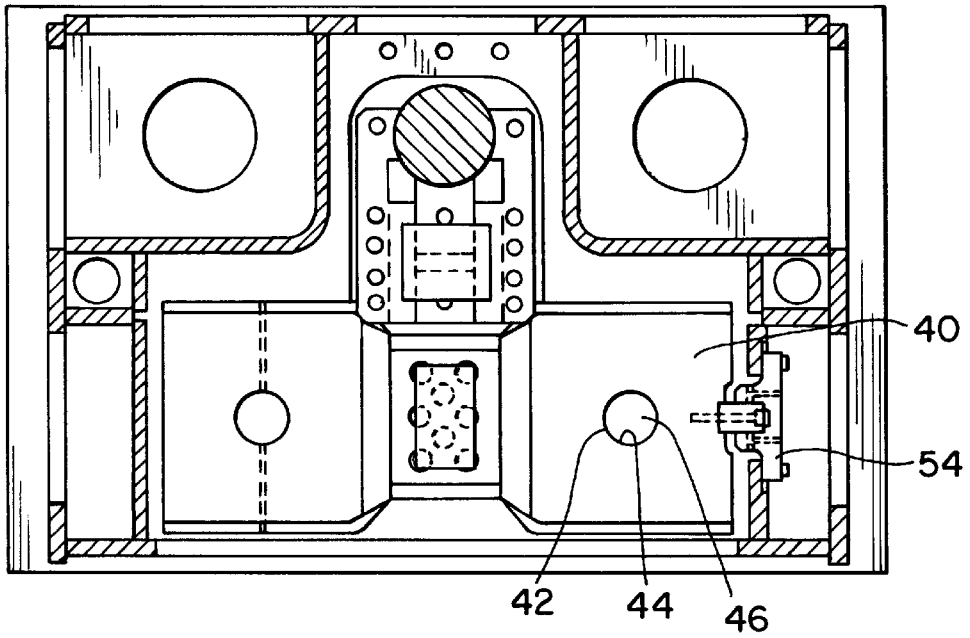
FIG. 5 is a is a cross-sectional view showing a balancer weight guide and associated balancing guide post.

Referring now to FIGS. 2 and 5, balancer weight 40 is used to dynamically balance the inertial forces created by slide 30. Balancer weight 40 contains aperture 42. Guide bushing 44 is located on the inner surface of balancer weight 40 defined by aperture 42. Balancer guide post 46 is disposed within aperture 42. During the operation of press 10, balancer weight 40 reciprocates along the longitudinal axis of balancer guide post 46 as slide 30 reciprocates. Balancer weight 40 is attached to slide 30 such that during press operation, balancer weight 40 and slide 30 reciprocate simultaneously yet, in opposite phase.

Figure 3:
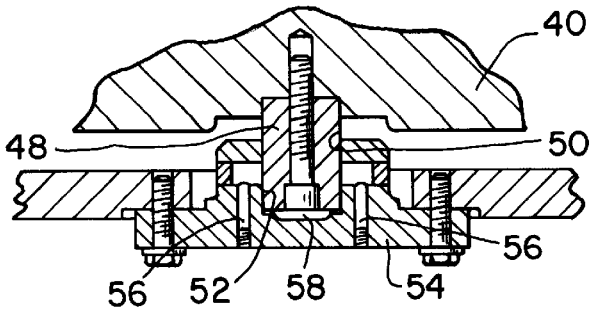
FIG. 3 is a cross-sectional view of a weight guide post and associated weight guide.

Referring back to FIG. 2 as well as FIG. 3, guide post 48 is attached on one side of balancer weight 40. Wear plate 50 is attached to the exterior of guide post 48. Bearing surfaces 52 are located on the inner surfaces of "U"-shaped weight guide 54. In one particular embodiment, bearing surfaces 52 are hydrostatics/hydrodynamic bearings. Oil supply port 56 supplies oil from the lubrication system (not shown) to the hydrostatic/hydrodynamic bearing surfaces 52. Weight guide 54 and associated bearing surfaces 52 are attached to press frame.

Figure 4:
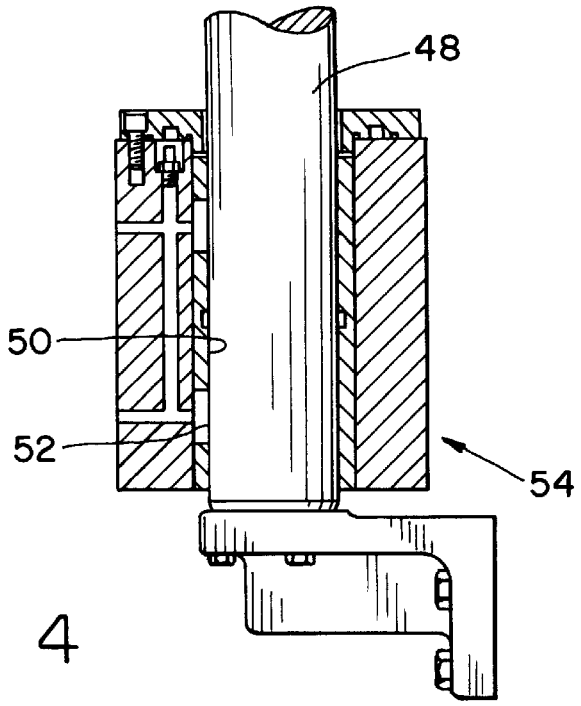
FIG. 4 is a cut-away/longitudinal cross-sectional view of a balancer weight.

Best seen in FIGS. 2 and 4, during press 10 operation, as balancer weight 40 reciprocates along the longitudinal axis of balancer guide post 46, balancer weight 40 also reciprocates longitudinally along guide post 48. Weight guide 54's "U"-shaped design prevents rotational movement of balancer weight 40 about both balancer guide post 46 and guide post 48. While "U"-shaped weight guide 54 is used to prevent the rotation of balancer weight 40, other shapes, designs or guide means may be employed which retard rotation of balancer weight 40 about the axis of balancer reciprocation.

Referring again to FIG. 3, gap 58 is located between weight guide 54 and guide post 48. Gap 58 provides clearance between guide post 48 and weight guide 54. Gap 58 allows for thermal expansion of the components in press 10 as press 10 operates. Weight guide 54, while allowing for a thermal growth differential between balancer weight 40 and the press frame, weight guide 54 provides a small enough clearance between bearing surfaces 52 and guide post 48 to reduce or eliminate vibration as balancer weight 40 reciprocates. Consequently, balancer weight 40 is guided accurately, reducing or eliminating vibration transmitted into slide 30 by balancer weight 40. This, in turn, improves the accuracy of slide 30 reciprocation and the quality of the part produced by press 10 operation. In addition, the reduction or elimination in vibration will also provide longer guide bearing life.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press comprising:

a frame with a crown and a bed;

a slide for reciprocating movement in opposed relation to said bed;

a dynamic balancer weight connected to said slide;

a guide post attached to said balancer weight;

a drive mechanism attached to said frame structure;

at least one weight guide attached to said frame; said weight guide disposed at least partially circumferentially about said guide post whereby preventing rotational motion of said balance weight about said guide post;

a flywheel rotatably driven by said drive mechanism, said flywheel mounted to said frame structure; and a crankshaft rotatably disposed within said crown and in driving connection with said slide, said crankshaft selectively connectable with said flywheel for driving rotation thereby.

2. A press according to claim 1 wherein said weight guide is "U"-shaped with an inner surface adjacent said guide post.

3. A press according to claim 2 wherein said weight guide inner surface contains a bearing surface.

4. A press according to claim 3 wherein said bearing surface comprises an hydrostatic bearing.

5. A press according to claim 4 wherein said bearing surface contains an hydrodynamic bearing.

6. A press according to claim 3 wherein said bearing surface contains an hydrodynamic bearing.

7. A press according to claim 1 further comprising:

a wear plate affixed to said guide post and disposed between said guide post and said weight guide.

8. A press according to claim 1 further comprising:

said balancer weight containing an aperture;

a balancer guide post disposed within said aperture; and said balancer weight reciprocateably mobile along said balancer guide post.

9. A guide system according to claim 8 further comprising:

a balancer guide post bushing attached to said balancer weight and disposed between said balance weight and said balancer guide post.

10. A mechanical press comprising:

a frame with a crown and a bed;

a slide for reciprocating movement in opposed relation to said bed;

a dynamic balancer weight connected to said slide; said balancer weight containing an aperture;

a balancer guide post disposed within said aperture, said balancer guide post having a longitudinal axis, said balancer weight reciprocateably mobile along said balancer guide post longitudinal axis;

a balancer guide post bushing attached to said balancer weight, said balancer guide post bushing disposed between said balancer weight and said balancer guide post;

a guide post with a wear plate affixed thereon, said guide post attached to said balancer weight;

at least one "U"-shaped weight guide containing hydrostatic/hydrodynamic bearing surfaces; said weight guide disposed about said guide post with said bearing surfaces adjacent said guide post whereby preventing rotational motion of said balance weight about said guide post;

a drive mechanism attached to said frame structure;

a flywheel rotatably driven by said drive mechanism, said flywheel mounted to said frame structure; and a crankshaft rotatably disposed within said frame structure and in driving connection with said slide, said crankshaft selectively connectable with said flywheel for driving rotation thereby.

* * * * *